United States Patent [19]

Brunet

[11] 4,359,923

[45] Nov. 23, 1982

[54] UNITARY GUITAR CONSTRUCTION

[76] Inventor: James W. Brunet, 215 Vann St., Syracuse, N.Y. 13206

[21] Appl. No.: 306,266

[22] Filed: Sep. 28, 1981

[51] Int. Cl.[3] ..... G10D 1/08

[52] U.S. Cl. ..... 84/267; 84/291; 84/292; 84/293

[58] Field of Search ..... 84/1.16, 291, 292, 293, 84/267

[56] References Cited

U.S. PATENT DOCUMENTS

| | | | |
|---|---|---|---|
| 3,072,007 | 1/1963 | Burke | 84/267 |
| 3,413,883 | 12/1968 | Helbourne | 84/267 |
| 3,456,063 | 7/1969 | Teranishi et al. | 84/1.16 |
| 3,771,408 | 11/1973 | Wright | 84/291 |
| 3,915,049 | 10/1975 | Bean | 84/1.16 |
| 4,088,050 | 5/1978 | Appel | 84/267 |
| 4,290,336 | 9/1981 | Peavey | 84/291 |

FOREIGN PATENT DOCUMENTS

| | | | |
|---|---|---|---|
| 2841029 | 3/1980 | Fed. Rep. of Germany | 84/291 |
| 2037049 | 7/1980 | United Kingdom | 84/291 |

*Primary Examiner*—Lawrence R. Franklin
*Attorney, Agent, or Firm*—Charles S. McGuire

[57] ABSTRACT

A guitar construction having a complete body, neck, head, nut and tail piece formed as a single, integral, metal casting with tuning pegs, finger board, bridge and strings mounted thereon. The body portion is in the usual bell-shaped outline, formed by a continuous metal rib with a plurality of other ribs, all integrally formed in the same casting, extending across the space enclosed by the continuous rib and themselves defining a plurality of other spaces extending through the body. Solid, planar sheets, preferably of transparent plastic, cover the front and rear sides of an opening defined by one set of ribs to form a hollow chamber. The bridge is affixed to one of the ribs defining the chamber to produce a resonant effect similar to that of a hollow body guitar, while retaining the open appearance and unitary construction. Conventional pick-up means for an electronic amplification system are mounted in one of the enclosed spaces.

9 Claims, 7 Drawing Figures

UNITARY GUITAR CONSTRUCTION

BACKGROUND OF THE INVENTION

The present invention relates to stringed musical instrument construction, and more specifically to an improved construction for a guitar, or similar instrument.

Musical instruments such as guitars have been constructed of a number of materials, typically, wood, plastic and metal. It is the usual practice to construct various portions of guitars separately and to join such separate portions in assembling the finished instrument. The various portions may be of the same or of different materials. In U.S. Pat. No. 3,072,007 of Burke, for example, a guitar is provided in kit form for assembly of wooden side and cover portions of the body with a metal portion. In other commercial forms of guitars it is common to fabricate various portions, e.g., the body and neck, separately and attach them in permanent fashion to provide the finished item.

Since the tonal quality and other factors concerned with optimum sound output are to some extend dependent upon the structural integrity of the instrument, there is inevitably some loss in quality due to the fact that various portions of the instrument, though permanently assembled, are actually separate pieces. There is also the possibility that through warping, accident or mishandling the separately formed portions, although initially joined in a secure manner, may become loose or detached.

It is a principal object of the present invention to provide a novel and improved construction for a guitar, or similar stringed instrument, which has superior sound qualities.

Another object is to provide a guitar which is extremely strong and durable, being extremely resistant to chipping, scratching, bending or warping.

A further object is to provide a guitar, or the like, having both a nut and tail piece which are formed integrally with the rest of the instrument, thereby improving the sustain of string vibration.

Other objects will in part be obvious and will in part appear hereinafter.

SUMMARY OF THE INVENTION

In accordance with the foregoing objects, the invention contemplates a guitar construction wherein all major portions, including head, nut, neck, body and tail piece are formed as a unitary, integral, metal casting, preferably of aluminum. Excessive weight is avoided by forming the head in the nature of a frame enclosing an open space, and the body of a plurality of interconnected metal ribs. The portion of the casting forming the neck is in the nature of a bottom wall and side walls defining a hollow cavity extending the length of the neck for receiving the fingerboard.

The nut is formed at the juncture of the neck and head, integrally therewith, and the tail piece extends laterally between a pair of the aforementioned ribs defining the body. Certain of the ribs define an enclosed space over which planar sheets, preferably of transparent material, are mounted to form a hollow, enclosed chamber. The bridge is mounted upon a lateral rib, forming one side of the enclosed chamber, parallel to the tail piece and extending between the same two ribs, integrally therewith. Conventional electronic pick-up means are mounted upon the planar sheet covering the front of the enclosed chamber.

DETAILED DESCRIPTION

Figure 1:
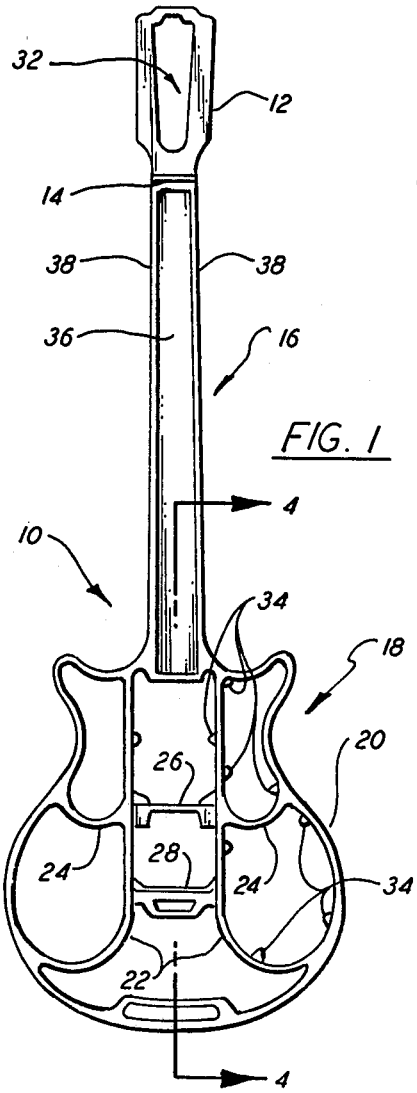
FIGS. 1 and 2 are front and rear elevational views, respectively, of a unitary casting upon which the guitar construction of the invention is based.
Figure 2:
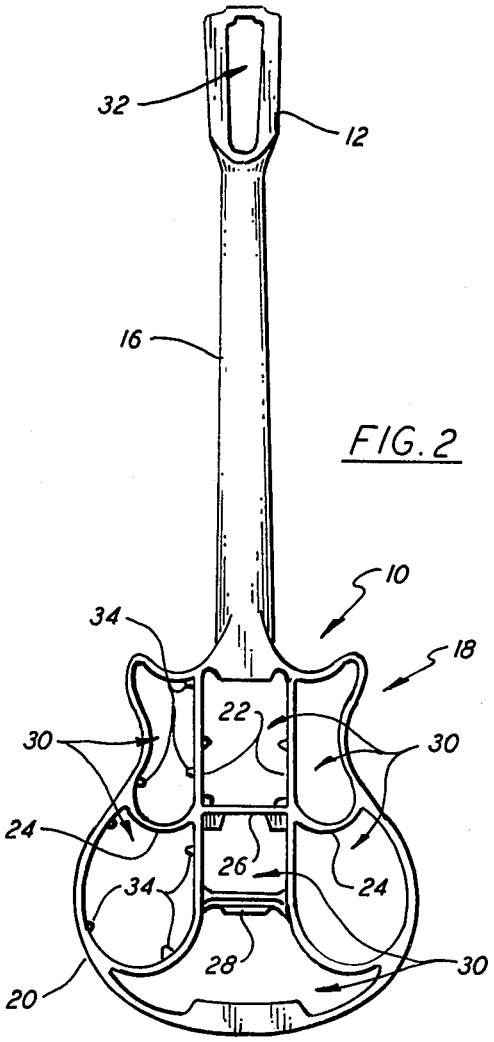
Figure 3:
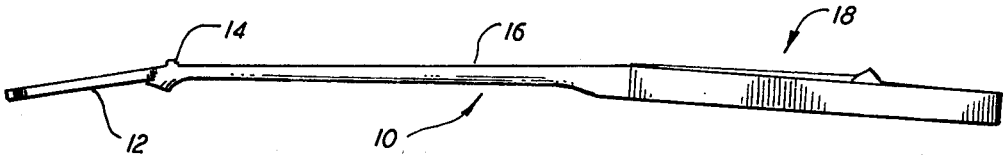
FIG. 3 is a side elevational view of the casting of FIGS. 1 and 2.

Referring now to the drawings, in FIGS. 1–4 is shown a unitary, integral, metal casting 10, preferably of aluminum, formed in a single cavity mold by conventional casting techniques. Casting 10 includes all of the basic elements of a guitar, or similar instrument, minus the strings, tuning pegs, fingerboard, bridge and any desired electronic pick-up and amplification means. That is, casting 10 is a continuous single piece of material which includes head 12, nut 14, neck 16, and a body portion generally denoted by reference numeral 18. The exterior outline of body 18 is formed by a continuous metal rib 20, extending from each side of the lower end of neck 16, integrally therewith, in the usual guitar body shape which, for purposes of the present application, shall be referred to as "bell-shaped".

Figure 4:
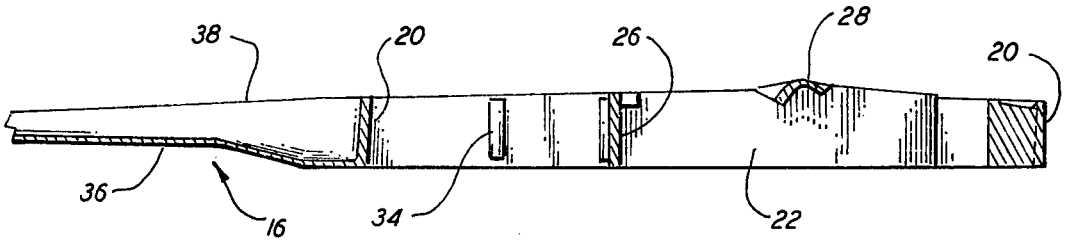
FIG. 4 is a fragmentary, side elevational view in section on the line 4—4 of FIG. 1.

A plurality of additional metal ribs extend through the open space enclosed by continuous rib 20. Two of such additional ribs 22 extend integrally from rib 20 near the junctures thereof with neck 16, parallel to one another over the major portion of their length and curvingly diverge to again integrally join rib 20 in the enlarged, lower portion of the bell shape defined thereby. Ribs 24 extend from ribs 22 to rib 20, and rib 26 and tail piece 28 extend laterally between parallel portions of ribs 22. All of ribs 20, 22, 24 and 26 may conveniently be of substantially constant, identical cross section, with tail piece 28 being of significantly smaller cross section, as seen in FIG. 4.

A plurality of open spaces 30 through body portion 18 are thus defined by continuous rib 20 and the plurality of ribs extending internally thereof. Also, head 12 is formed in the nature of an open frame enclosing open space 32. Integrally formed on portions of the internal surfaces or ribs 20 and 22 are metal lugs or bosses 34 which may be drilled and tapped for mounting of certain additional pieces, as described later. Neck 16 is formed with a bottom wall 36 and side walls 38 extending the length thereof and defining a hollow cavity on the front side of the neck wherein a separately fabricated fingerboard may be fixedly attached, also as later described.

Figure 5:
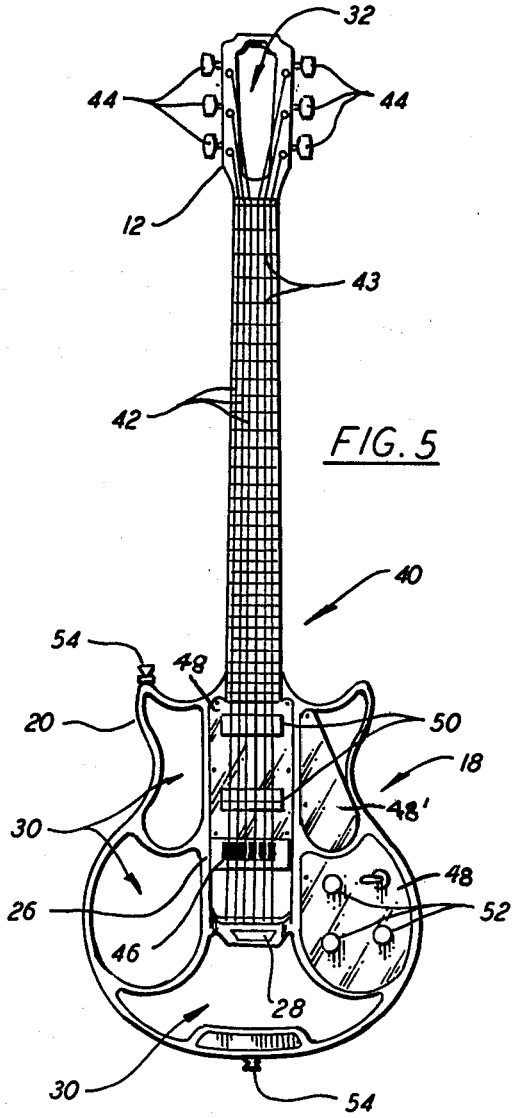
FIGS. 5, 6 and 7 are front, rear and side elevational views, respectively, of a fully assembled guitar incorporating the casting of FIGS. 1–4.
Figure 6:
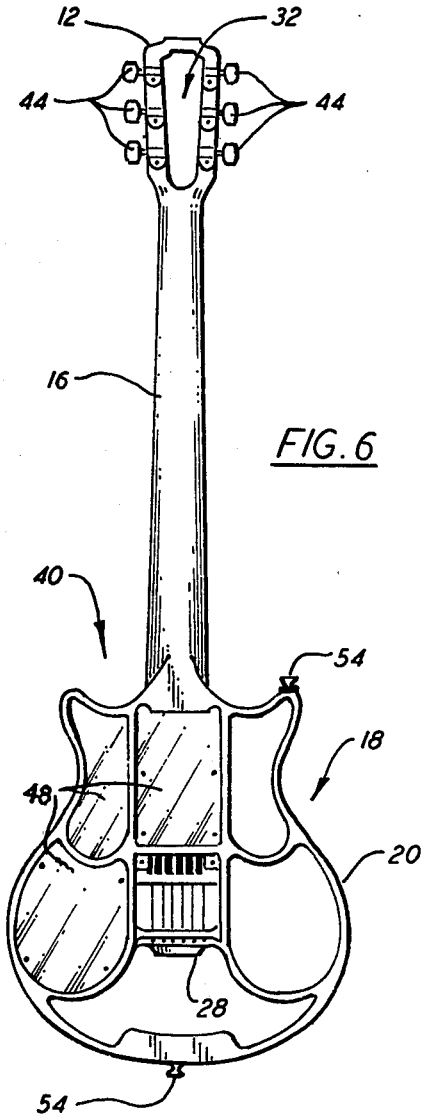
Figure 7:
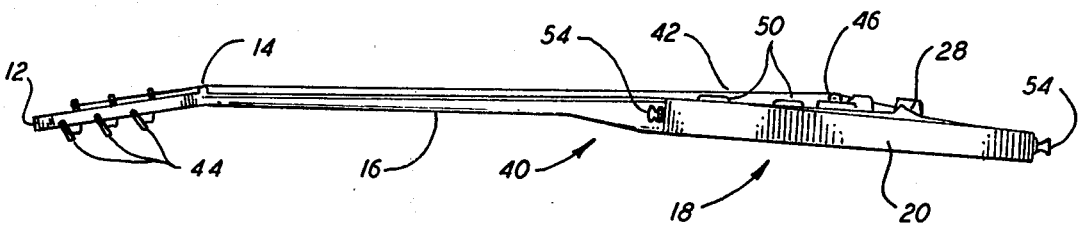

Turning now to FIGS. 5–7, a completely assembled guitar based upon the single-piece casting of FIGS. 1–4 is shown. The completed guitar, denoted generally by reference numeral 40, includes strings 42 anchored at one end to tail piece 28 and at the other to tuning pegs 44, passing over and contacting nut 14 at the juncture of head 12 and neck 16. Strings 42 are thus tensioned between nut 14 and tail piece 28, both integral parts of unitary casting 10. Metal frets 44 form a portion of the fingerboard which is received and affixed over the hollow cavity defined by walls 36 and 38 of neck 16. The strings are supported in essentially parallel relation and spaced a desired distance from frets 44 by bridge 46 which is mounted upon rib 26.

The particular pattern of ribs 20, 22, 24 and 26 and tail piece 28 of the illustrated embodiment provides a total of seven open spaces through body 18 separated by the ribs and/or tail piece. In the assembled form of guitar 40, two of these spaces are covered on both the front and rear sides of the guitar by rigid, planar sheets 48, preferably of transparent plastic. The sheet on the front side of the guitar 40 which covers the opening between ribs, 20, 22 and 26 serves as the support for the coil-wound magnets 50 which provide the inductive pick-ups for the sound amplification system. The sound qualitites of guitar 40 are particularly enhanced by the resonant effect provided by the hollow chamber defined by ribs 20, 22 and 26 and sheets 48 on the front and rear sides thereof. Additional components of the system are carried within the space covered front and rear by the other sheets 48, the front one of which also serves as a support for control knobs 52 by means of which certain manual adjustments of amplification system components may be effected. An additional sheet 48, partially covers, on the front side only, the space adjacent the position at which the strings are plucked to serve as a hand or finger rest or pick guard.

Lugs 34 are drilled and tapped to accept screws which secure sheets 48 in place. Use of a transparent material for sheets 48 also enhances the open-work appearance of guitar 40. Also, various pick-up and wiring combinations may be conveniently interchanged. Rib 20 may also be drilled and tapped for mounting of knobs 54 to which a support strap may be attached.

The described construction fulfills the desired objectives through the provision of a unitary casting containing all rigid, non-adjustable portions of the instrument. Improved tone and clarity are achieved by the design, as well as superior sustain by integrating the nut and tail piece in the one-piece casting. The neck obviously requires no adjusting and will not warp. Furthermore, the entire unit combines a most attractive and unusual appearance with an extremely rugged and durable construction.

Thus the construction of the present invention provides an instrument combining the sustain of a solid body with the mellow sound of a hollow body. This is achieved by forming the body, neck and head as a single piece casting, forming a hollow chamber defined by certain of the body ribs with front and rear covering sheets, mounting the bridge on one of the chamber-defining ribs and the pick-up means on one of the covering sheets.

What is claimed is:

1. A guitar, or similar stringed instrument, comprising:

(a) a unitary, metal casting forming a body, a neck formed integrally with said body and extending from one side thereof, and a head formed integrally with said neck and extending from the end thereof opposite said body;

(b) said body having an outline defined by a continuous metal rib and a plurality of internal ribs formed integrally with and extending through the space enclosed by said continuous rib;

(c) a plurality of tensioned strings extending between anchored position on said head and a tail piece on said body;

(d) at least two planar sheets affixed to opposite sides of certain of said ribs to define an enclosed, hollow chamber underlying said strings between said neck and said tail piece;

(e) a bridge supporting said strings in spaced relation to one of said sheets and affixed to at least one of said certain ribs defining said chamber, whereby vibrations of said strings are transmitted through said bridge and the rib to which it is affixed into said chamber; and (f) electrical pick-up means mounted upon and supported solely by one of said sheets in spaced relation to said strings and overlying said chamber.

2. The invention according to claim 1 wherein said unitary casting includes a nut substantially at the juncture of said neck and head.

3. The invention according to claim 2 wherein said neck comprises a bottom wall and two side walls extending the length thereof and defining a cavity, said instrument further including a fingerboard fixedly positioned over said cavity.

4. The invention according to claim 2 wherein said head includes a central opening extending therethrough and surrounded by the portion of said unitary casting forming said head.

5. The invention according to claim 1 wherein said sheets are formed of transparent material.

6. The invention according to claim 5 wherein said material is essentially rigid.

7. The invention according to claim 1 wherein said tail piece is formed integrally with and extends between two of said certain ribs.

8. The invention according to claim 7 wherein the surfaces of said continuous and said internal ribs on the string side of said guitar lie in a common plane and the surface of said tail piece is raised from said plane.

9. The invention according to claim 1 wherein one side of said chamber is formed by the juncture of said neck and said body.

* * * * *